US009803347B2

(12) United States Patent
Hocaoglu

(10) Patent No.: US 9,803,347 B2
(45) **Date of Patent: *Oct. 31, 2017**

(54) SEAMLESS UNDERMOUNT STAINLESS STEEL SINK SYSTEM

(71) Applicant: Mehmet Hocaoglu, Ft. Lauderdale, FL (US)

(72) Inventor: Mehmet Hocaoglu, Ft. Lauderdale, FL (US)

( * ) Notice: Subject to any disclaimer, the term of this patent is extended or adjusted under 35 U.S.C. 154(b) by 38 days.

This patent is subject to a terminal disclaimer.

(21) Appl. No.: 14/465,337

(22) Filed: Aug. 21, 2014

(65) Prior Publication Data

US 2015/0059084 A1 Mar. 5, 2015

Related U.S. Application Data

(63) Continuation-in-part of application No. 14/263,353, filed on Apr. 28, 2014, which is a continuation-in-part of application No. 14/101,939, filed on Dec. 10, 2013.

(60) Provisional application No. 61/890,906, filed on Oct. 15, 2013, provisional application No. 61/871,569, filed on Aug. 29, 2013.

(51) Int. Cl.
*E03C 1/33* (2006.01)
*E03C 1/18* (2006.01)

(52) U.S. Cl.
CPC ..... *E03C 1/335* (2013.01); *E03C 1/18* (2013.01)

(58) Field of Classification Search
USPC ..... 4/632–636
See application file for complete search history.

(56) References Cited

U.S. PATENT DOCUMENTS

| | | | |
|---|---|---|---|
| 2,495,853 | A | 1/1950 | Lindgren |
| 4,175,292 | A | 11/1979 | Morrison |
| 4,374,695 | A | 2/1983 | Ikeda et al. |
| 5,016,297 | A | 5/1991 | Sauter et al. |
| 5,551,103 | A | 9/1996 | Drozdowich et al. |
| 5,754,991 | A | 5/1998 | Drozdowich et al. |
| 5,997,009 | A | 12/1999 | Geise |
| 6,349,429 | B1 | 2/2002 | Zurba et al. |
| 6,571,406 | B2 | 6/2003 | Gerloff |

(Continued)

FOREIGN PATENT DOCUMENTS

| | | | |
|---|---|---|---|
| EP | 1422352 | A2 | 5/2004 |
| FR | 2757031 | A1 | 6/1998 |
| FR | 2792345 | A1 | 10/2000 |

*Primary Examiner* — Lauren Crane
(74) *Attorney, Agent, or Firm* — Malloy & Malloy, P.L.

(57) ABSTRACT

A seamless undermount stainless steel sink system includes a solid countertop constructed of granite, marble, quartz stone, quartzite, porcelain, glass, engineered stone, multi-layered and/or composite materials, and having a sink mounting aperture defining an inner periphery disposed therethrough. The system also includes a stainless steel sink having a sidewall with a rimless upper edge defining an outer periphery therearound. A mounting assembly is attached to a portion of the stainless steel sink at a predetermined mounting depth below the rimless upper edge, and an interface is formed between the stainless steel sink and the solid countertop. A sealing assembly is disposed in the interface between the rimless upper edge of the stainless steel sink and the solid countertop to prevent water, food, or other debris from getting in between the stainless steel sink and the solid countertop.

18 Claims, 14 Drawing Sheets

(56) References Cited

U.S. PATENT DOCUMENTS

| | | | | |
|---|---|---|---|---|
| 6,986,174 | B2 | 1/2006 | Brown | |
| 7,007,317 | B1 * | 3/2006 | Brown | E03C 1/33 4/631 |
| 7,216,461 | B1 | 5/2007 | Clemmer | |
| 7,263,811 | B1 | 9/2007 | Clemmer | |
| 7,278,176 | B2 | 10/2007 | Clarke | |
| 8,418,281 | B2 | 4/2013 | Sutter | |
| 2008/0178381 | A1 * | 7/2008 | Montgomery | A47K 3/40 4/619 |
| 2009/0144893 | A1 * | 6/2009 | Cusimano | E03C 1/33 4/643 |
| 2010/0017956 | A1 | 1/2010 | Chen | |
| 2012/0306165 | A1 | 12/2012 | Sutter | |
| 2014/0250589 | A1 * | 9/2014 | Sgarlata | B29C 39/00 4/643 |

* cited by examiner

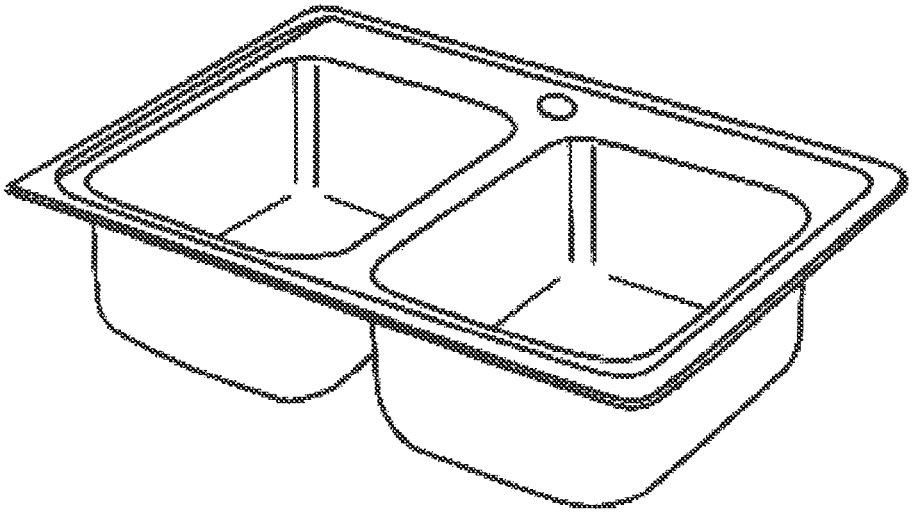
FIGURE 1 – PRIOR ART Topmount Sink
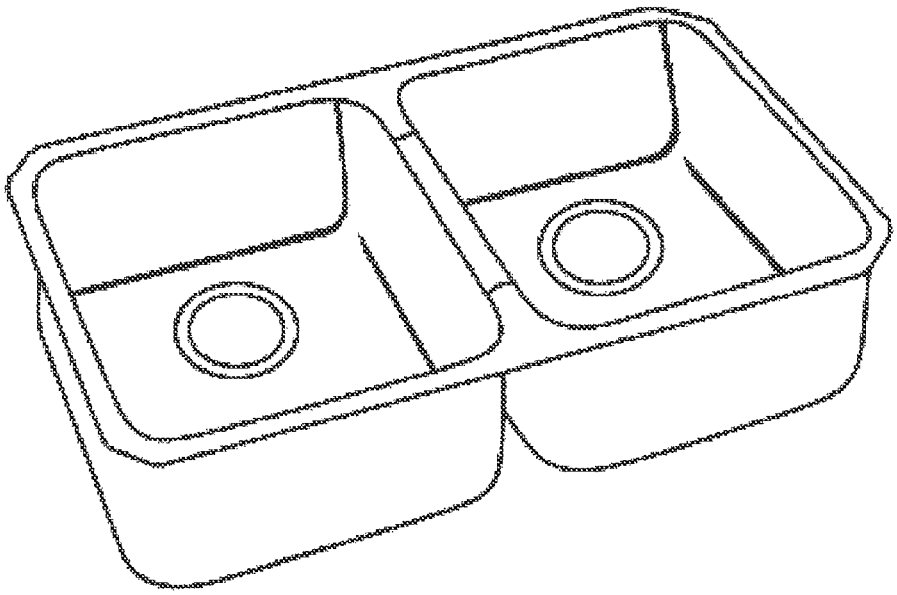
FIGURE 2 – PRIOR ART Undermount Sink FIG 7
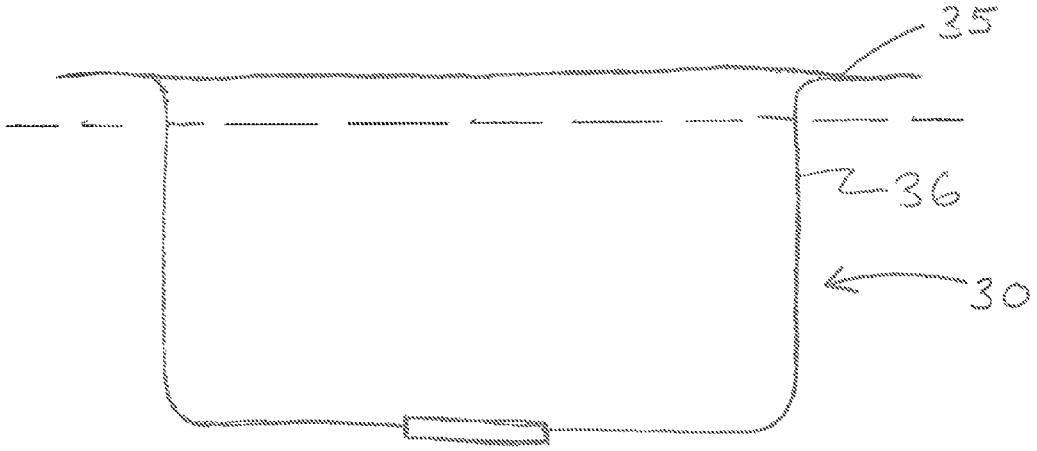
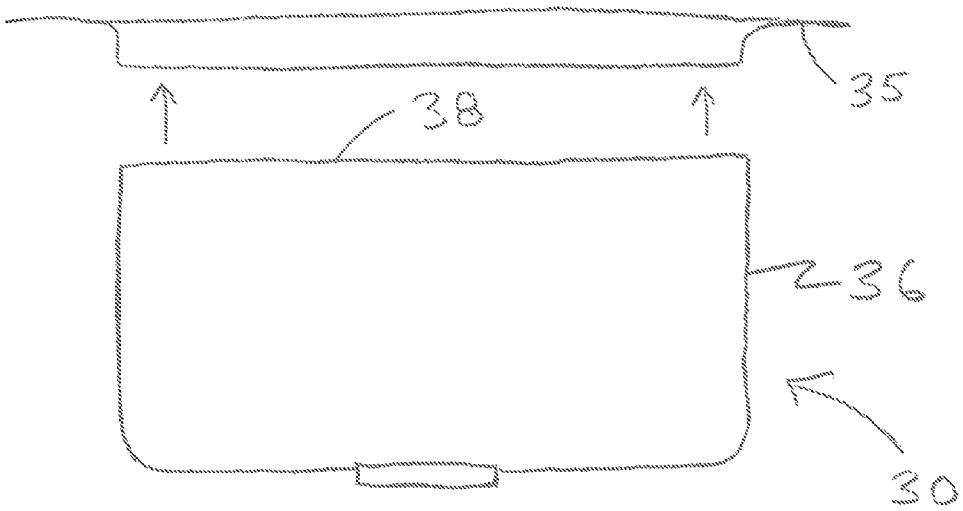
FIG 7A

SEAMLESS UNDERMOUNT STAINLESS STEEL SINK SYSTEM

BACKGROUND OF THE INVENTION

Field of the Invention

The present invention is directed to a system comprising a rimless stainless steel sink structured and disposed to be undermounted to a solid countertop wherein an interface between the stainless steel sink and the solid countertop comprises a seal which prevents water, bacteria, or debris from entering between the rimless upper edge of the stainless steel sink and the solid countertop. The present invention is further directed to methods for seamless undermount installation of a stainless steel sink to a solid countertop including but not limited to granite, marble, quartz stone, quartzite, porcelain, glass, engineered stone, multi-layered and/or composite materials.

Description of the Related Art

Stainless steel is the most popular sink style on the market today, and provides a complementary match to many kitchen appliances, such as, refrigerators, stoves, dishwashers, water coolers, etc., which are also available in stainless steel or stainless steel finish. Sinks made of stainless steel offer numerous benefits including resistance to chipping, cracking or peeling. Furthermore, stainless steel sinks will not rust or fade, and they are easy to clean and maintain for a long periods of time relative to other materials of construction.

There are different types and corresponding methods for mounting stainless steel sinks to countertops. The most common and traditional type is a topmount sink, such as is shown in FIG. 1—PRIOR ART Topmount Sink. As is readily seen from FIG. 1, a wide flange extends completely around the topmount sink such that when the topmount sink is positioned through a cut-out in a solid material countertop, the flange rests on the top surface of the countertop and is secured thereto via adhesives and/or mechanical fasteners. As will be appreciated, however, the interface between the flange and the top surface of the countertop provides a place for water, moisture, bacteria, food, and other debris to accumulate thereby creating a visually unappealing and potentially unsanitary condition around the stainless steel sink.

Another common type of stainless steel sink for mounting to a countertop is an undermount sink. An example of a PRIOR ART Undermount Sink is illustrated in FIG. 2. As shown in FIG. 2, the undermount sink comprises a much narrower flange which is structured and disposed to enable the sink to be attached to the bottom surface of a solid countertop below a sink cut-out therethrough. More in particular, undermount sinks have flat rims or flanges around the edges which may be glued and/or mechanically mounted to the bottom surface of the countertop using mounting clips and screws. The lip or sidewall of the sink cut out through the solid countertop must be finished to match the top surface, as it remains readily visible. Once again, however, an interface exists at the bottom of the sink cut out and the top of the undermount sink thereby allowing water, moisture, bacteria, food, and other debris to accumulate, once again, creating a visually unappealing and potentially unsanitary condition around the stainless steel sink.

More recently, a so-called "Flush-Mount" sink has been introduced to the market which has a much narrower and flatter rim or flange around the top. These flush mount sinks are structured to be mounted to a solid countertop through the top, wherein the narrow flat rim or flange rests in an equally narrow and thin recess cut into the solid countertop around the sink cut-out. As such, the combination of the narrow flat flange and the recess cut into the countertop serves to approximate a "flush-mount" appearance. As will be appreciated by those of skill in the art, however, considerable time, expense, expertise, and special equipment are required in order to cut a recess into granite or marble with the precision required to receive such a "flush-mount" stainless steel sink and approximate a "flush-mount" appearance.

As such, it would be beneficial to provide a seamless stainless steel sink system for installation to a solid material countertop including, but not limited to granite, marble, quartz stone, quartzite, porcelain, glass, engineered stone, multi-layered and/or composite materials, which eliminates an interface where water, moisture, bacteria, food, and/or other debris can accumulate and create unsightly and unsanitary conditions. It would be further advantageous for such a seamless stainless steel sink system to utilize standard fabrication materials and techniques in order to provide an economical alternative to the aforementioned "flush-mount" stainless steel sink systems. It would further be helpful for such a seamless stainless steel sink system to accommodate a variety of popular sink configurations including, but not limited to, rectangular, oval, kidney shaped, etc. Another benefit may be obtained by providing a stainless steel sink having a recessed divider between bowls to allow for seamless undermount installation of a stainless steel sink having more than one bowl.

SUMMARY OF THE INVENTION

The present invention is directed to a seamless undermount stainless steel sink system. A seamless undermount stainless steel sink system in accordance with the present invention comprises a stainless steel sink and a solid countertop.

In at least one embodiment, the solid countertop comprises a stone material of construction such as, but not limited to granite, marble, quartz stone, or quartzite. In at least one other embodiment, a solid countertop comprises granite, marble, quartz stone, quartzite, porcelain, glass, engineered stone, multi-layered and/or composite materials. The solid countertop has a top surface and a bottom surface, wherein the top surface and the bottom surface at least partially define a thickness therebetween, and in at least one embodiment, the thickness of the solid countertop remains substantially the same between the top surface and the bottom surface. A sink mounting aperture is disposed through the solid countertop, and the sink mounting aperture comprises an inner periphery. In at least one embodiment, a receiving channel is formed along and around at least a portion of the inner periphery, and in at least one further embodiment, a receiving channel is formed substantially along and around a lower portion of the inner periphery.

As previously stated, the present system further comprises a stainless steel sink, and the stainless steel sink includes a sidewall which partially forms at least one bowl. In at least one embodiment, the stainless steel sink comprises a plurality of bowls separated from one another by a corresponding recessed divider, as discussed in further detail below. A stainless steel sink in accordance with the present invention further comprises a rimless upper edge along and around the sidewall, and an outer periphery is defined around the rimless upper edge.

The present seamless undermount stainless steel sink system also includes a mounting assembly which is structured to securely mount the stainless steel sink to the solid countertop. In one embodiment, the mounting assembly comprises at least one mounting bracket attached to a portion of the stainless steel sink at a predetermined mounting depth below the rimless upper end of the stainless steel sink, and in one further embodiment, the mounting assembly comprises a plurality of mounting brackets each being attached to a portion of the stainless steel sink, and each being positioned at a predetermined mounting depth below the rimless upper edge of the stainless steel sink.

A mounting bracket in accordance with one embodiment of the present invention includes a sink flange, which is utilized to attach the mounting flange to a portion of the stainless steel sink, and a countertop flange to secure the stainless steel sink to the solid countertop. In one embodiment, the countertop flange includes a countertop flange surface which, in at least one embodiment, is operatively disposed in a substantially perpendicular orientation relative to the sidewall of the stainless steel sink and is positioned at the predetermined mounting depth below the rimless upper edge of the stainless steel sink.

In at least one embodiment, an upper interface is formed between the outer periphery of the stainless steel sink and the inner periphery of the solid countertop and, in accordance with the present invention, an upper seal is disposed in the upper interface between the rimless upper edge of the stainless steel sink and the top surface of the solid countertop. More importantly, the upper seal prevents water, moisture, bacteria, food, or debris from entering between the rimless upper edge of the stainless steel sink and the top surface of the solid countertop.

A channel interface is formed between the rimless upper edge of a stainless steel sink and a finished periphery surface of a sink mounting aperture in accordance with at least one further embodiment of the present invention. A channel seal is disposed in the channel interface between the rimless upper edge and the finished periphery surface, once again, so as to prevent water, moisture, bacteria, food, or debris from entering between the stainless steel sink and the solid countertop.

The present invention is further directed to methods for seamless undermount installation of a stainless steel sink to a solid countertop, once again, including but not limited to granite, marble, quartz stone, quartzite, porcelain, glass, engineered stone, multi-layered and/or composite materials.

In at least embodiment, the present method includes fabricating a stainless steel sink with a rimless upper edge defining an outer periphery therearound, such as may be accomplished by hand fabrication. Of course, as most stainless steel sinks manufactured today are drawn and comprise an upper flange or lip. As such, in one embodiment, the present method includes removing the mounting flange or lip from the stainless steel sink in order to obtain a rimless upper edge.

The present method further includes preparing a mounting template based on the outer periphery of the rimless upper edge of the stainless steel sink, and creating a sink mounting aperture through the solid countertop between a top surface and a bottom surface based on the mounting template, wherein the sink mounting aperture comprises an inner periphery configured to receive the outer periphery of the rimless upper edge of the stainless steel sink therethrough.

Next, in at least one embodiment, one or more mounting brackets are positioned at a predetermined mounting depth below the rimless upper edge of the stainless steel sink, wherein each mounting bracket has a sink flange and a countertop flange. In at least one further embodiment, the countertop flange comprises a countertop flange surface which is positioned at the predetermined mounting depth below the rimless upper edge of the stainless steel sink, and the present method further includes attaching one mounting bracket to the stainless steel sink.

Once the mounting bracket or plurality of mounting brackets are positioned, and in at least one embodiment, attached to the stainless steel sink, the rimless upper edge of the stainless steel sink is positioned through the sink mounting aperture of the solid countertop such that each countertop flange surface is adjacent to the bottom surface of the solid countertop, and the stainless steel sink is secured to the bottom surface of the solid countertop via the at least one mounting bracket.

One alternate embodiment of the method in accordance with the present invention comprises positioning a rimless upper edge of a stainless steel sink into a receiving channel of a sink mounting aperture such that a countertop flange surface is adjacent to a bottom surface of a solid countertop, and the stainless steel sink is secured to the bottom surface of the solid countertop via the at least one mounting bracket.

Finally, the present method includes applying a seal along an interface between the stainless steel sink and the solid countertop, wherein the upper seal prevents water, moisture, bacteria, and debris from entering between the stainless steel sink and the solid countertop.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1 is a perspective view of a conventional PRIOR ART topmount sink.

FIG. 2 is a perspective view of a conventional PRIOR ART undermount sink.

FIG. 7 is a side elevation view of one illustrative embodiment of a stainless steel sink in accordance with the present invention prior to removal of a countertop flange.

FIG. 7A is a side elevation view of the stainless steel sink of FIG. 5 after removal of the countertop flange.

Like reference numerals refer to like parts throughout the several views of the drawings.

DETAILED DESCRIPTION

Figure 5:
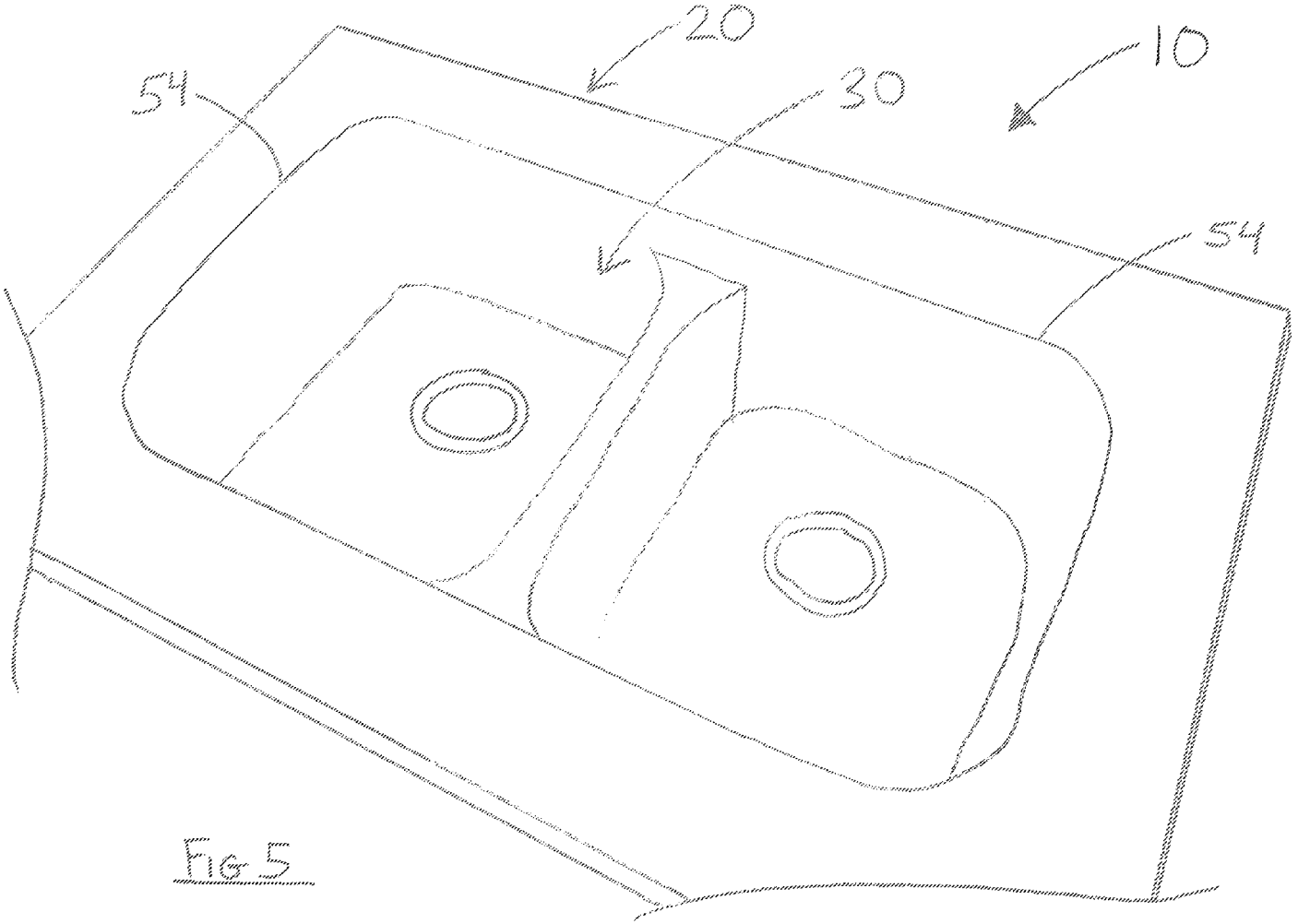
FIG. 5 is a perspective view of the stainless steel sink mounted to the solid countertop in accordance with the embodiment of FIG. 4 of present invention.
Figure 5A:
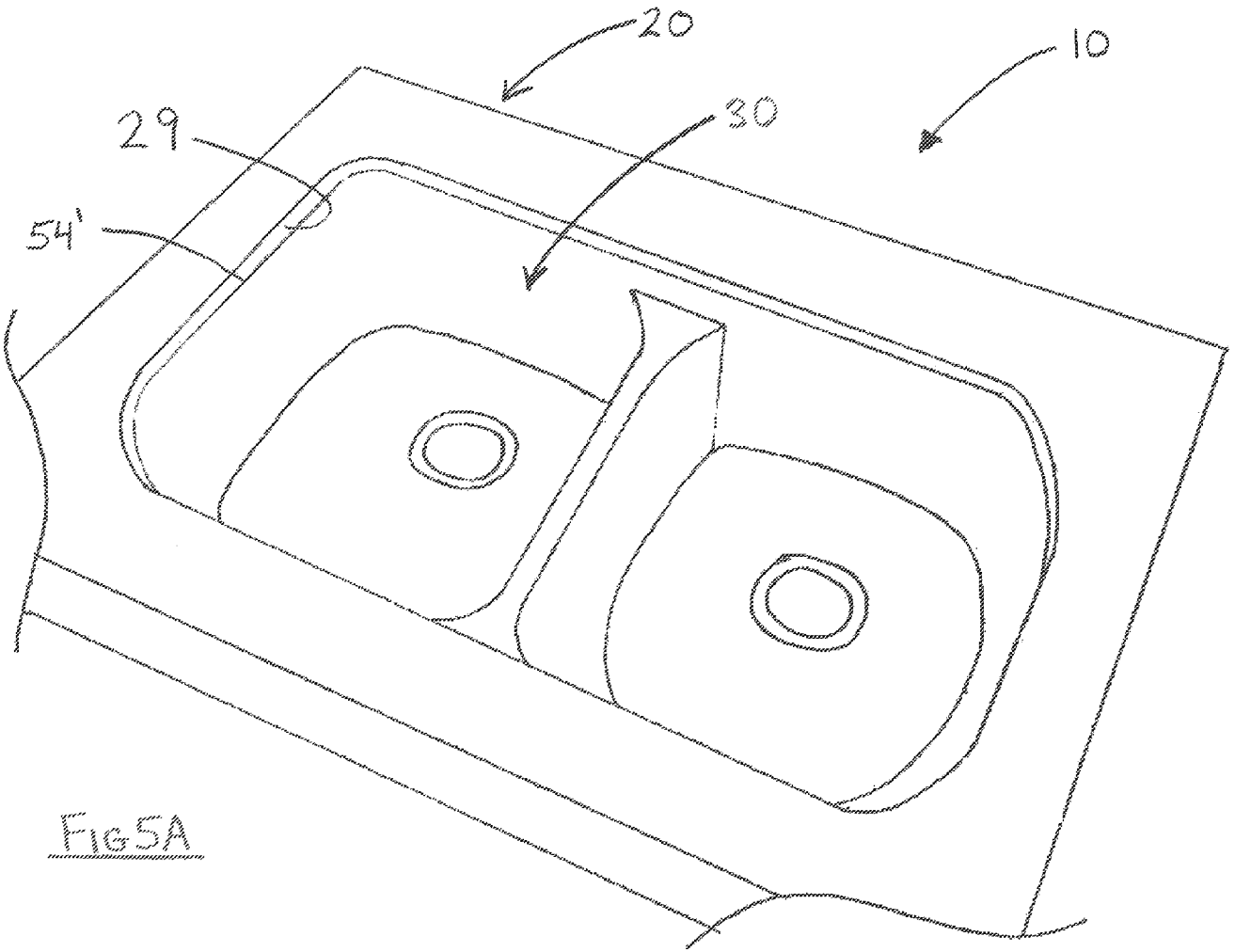
FIG. 5A is a perspective view of the stainless steel sink mounted to the solid countertop in accordance with the embodiment of FIG. 4A of present invention.

As stated above, the present invention is directed to a seamless undermount stainless steel sink system which is generally shown as 10 throughout the figures. More in particular, and with reference to FIG. 5, the present system 10 comprises a solid countertop 20 and a stainless steel sink 30. As is apparent from FIG. 5, an upper seal 54 between the solid countertop 20 and the upper edge of the stainless steel sink 30 provides a virtually seamless interface between the solid countertop 20 and the stainless steel sink 30. FIG. 5A is illustrative of one alternate embodiment of a seamless interface via a channel seal 54' between a rimless upper edge of the stainless steel sink 30 and a finished periphery surface 29 of the solid countertop 20.

In at least one embodiment of the present system 10, a solid countertop 20 is constructed from a solid material including, but not limited to, granite, marble, limestone, quartz stone, engineered stone, for example, acrylic and polyester composite engineered stone, recycled glass, and hardwood. In at least one other embodiment, a solid countertop 20 is constructed from granite, marble, quartz stone, quartzite, porcelain, glass, engineered stone, multi-layered and/or composite materials. At least one side of the solid countertop 20, such as top surface 22, is sanded, polished, buffed, etc., as needed in order to provide a smooth, even, and aesthetically appealing surface.

Figure 4:
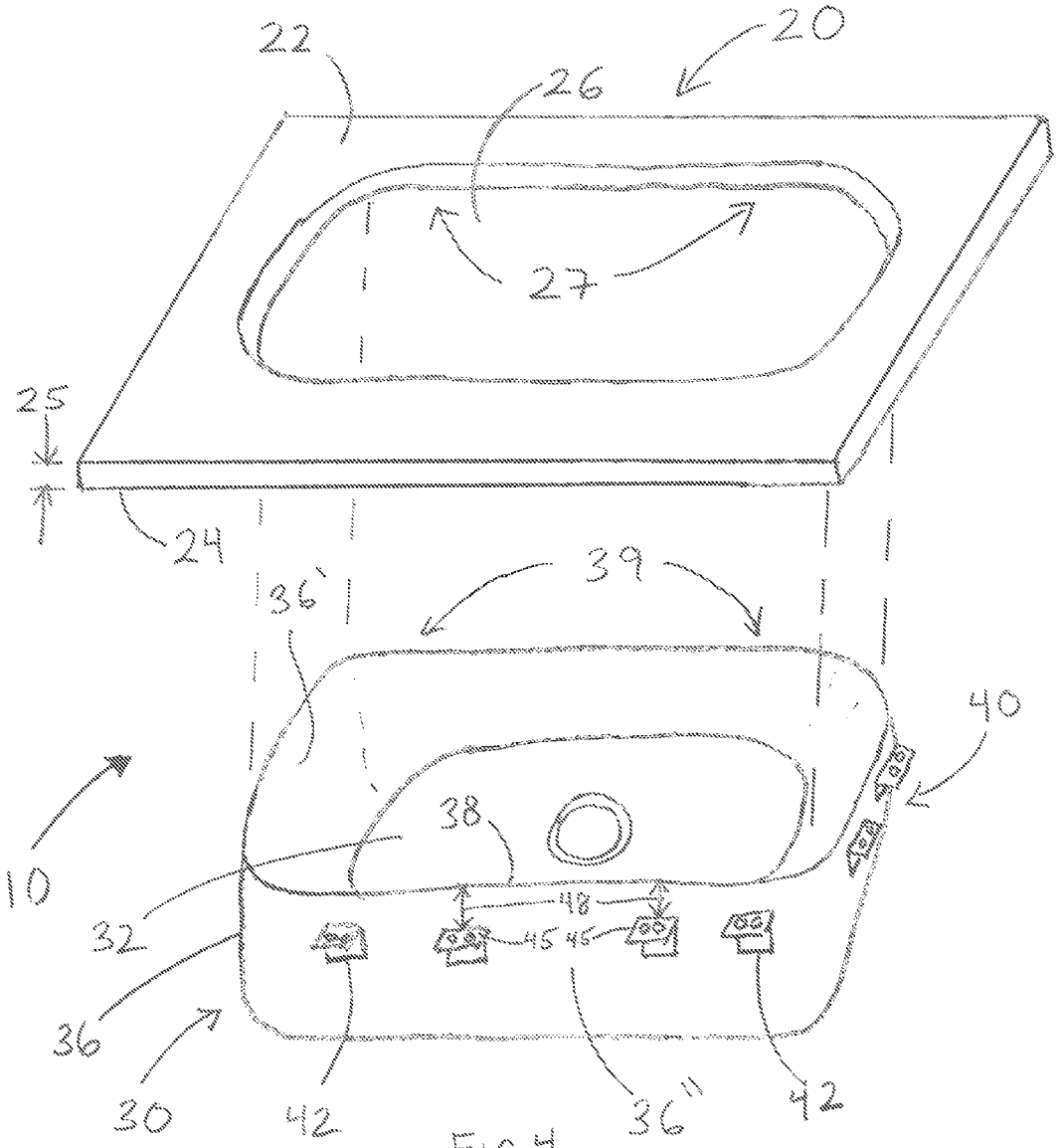
FIG. 4 is an exploded view of one illustrative embodiment of a stainless steel sink, mounting assembly, and solid countertop in accordance with the present invention.
Figure 4A:
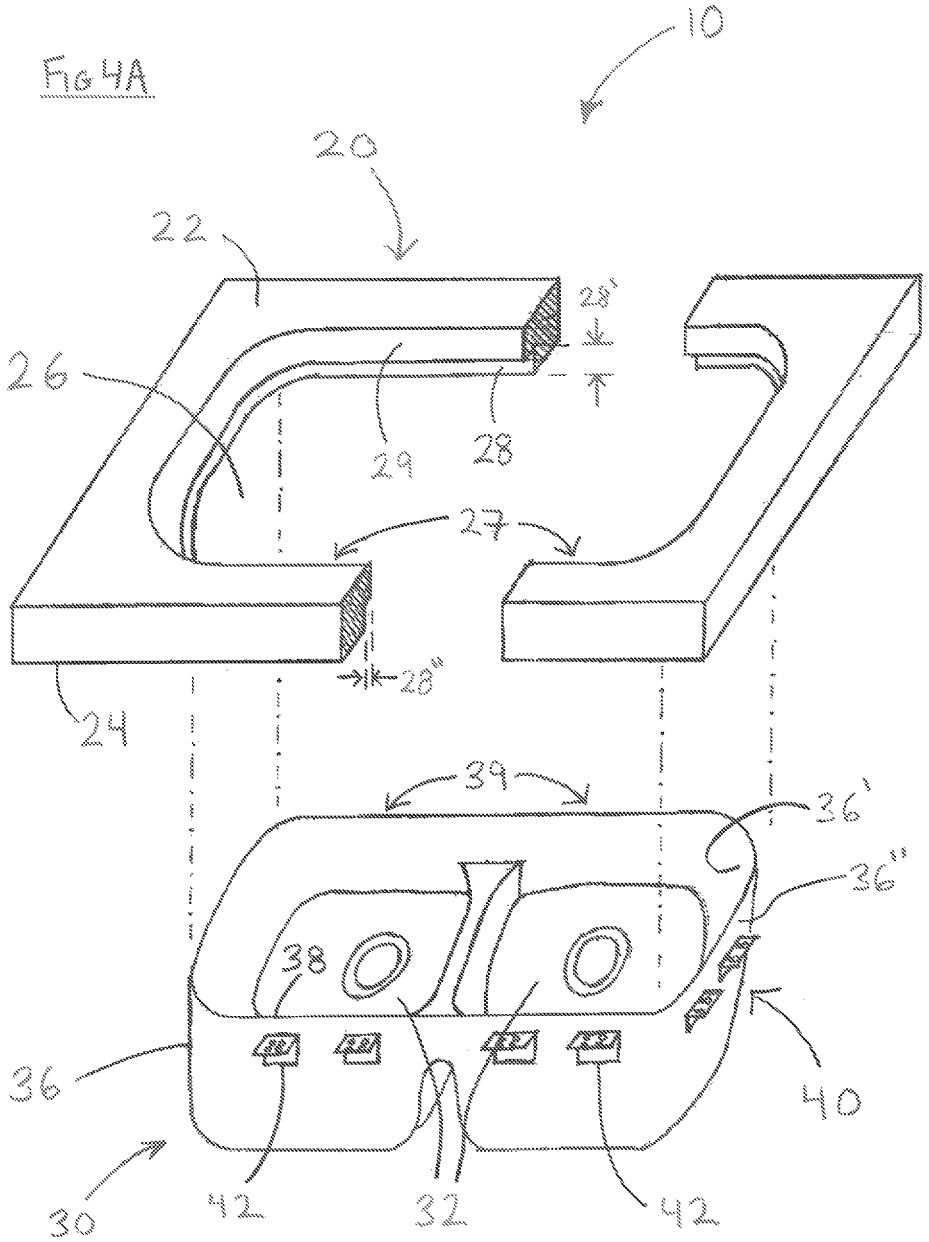
FIG. 4A is an exploded view of another illustrative embodiment of a stainless steel sink, mounting assembly, and solid countertop in accordance with the present invention.

FIGS. 4 and 4A are illustrative of a few alternate embodiments of a solid countertop 20 in accordance with the present invention comprising a top surface 22 and a bottom surface 24. As FIG. 4 further illustrates, the top surface 22 and bottom surface 24 at least partially define a thickness 25 therebetween, which is discussed in greater detail below with regard to the seamless interface between the solid countertop 20 and the stainless steel sink 30. Looking again to the illustrative embodiments of FIGS. 4 and 4A, the solid countertop 20 includes a sink mounting aperture 26 disposed therethrough. As will be appreciated by those skilled in the art, the sink mounting aperture 26 may be created by cutting through the solid countertop 20 in accordance with a template or guide which is drawn, etched, or temporarily attached thereto. It will be further appreciated that the sink mounting aperture 26 may be formed via drilling and or sawing utilizing bits and/or blades which are specifically designed for cutting through stone materials, such as, once again, granite, marble, quartz stone, etc. FIG. 4 further illustrates a solid countertop 20 in accordance with the present invention wherein the sink mounting aperture 26 at least partially defines an inner periphery 27 which extends along and around the entire inner edge of the sink mounting aperture 26.

In the illustrative embodiment of FIG. 4A, in addition to the sink mounting aperture 26, the solid countertop 20 further comprises a receiving channel 28 formed along and around the inner periphery 27 of the sink mounting aperture 26. As shown in FIG. 4A, the receiving channel 28 defines a channel height 28' extending upwardly from the bottom surface 24 of the solid countertop 20. As also shown in FIG. 4A, the receiving channel 28 further defines a channel depth 28", which corresponds to a thickness between the inner wall 36' and the outer wall 36" of the sidewall 36 of the stainless steel sink 30, as discussed further below. The receiving channel 28 may be formed via CNC cutting tools utilizing bits and/or blades which are specifically designed for cutting through stone materials, such as, once again, granite, marble, quartz, etc.

The inner periphery 27 of the sink mounting aperture 26 as shown in the embodiment of FIG. 4A further comprises a finished periphery surface 29 extending from the top surface 22 of the solid countertop 20 itself to the top of the receiving channel 28. The finished periphery surface 29 is sanded, polished, buffed, etc., as needed in order to provide a smooth, even, and aesthetically appealing surface to match the top surface 22 of the solid countertop 20.

As previously stated above, a seamless undermount stainless steel sink system 10 in accordance with the present invention further comprises a stainless steel sink 30. It is understood to be within the scope and intent of the present invention for a stainless steel sink 30 to be constructed of any of a variety of grades of stainless steel which are presently utilized for the formation of sinks including, but not limited to, Type 304 stainless steel, Type 302 stainless steel, and Type 316 stainless steel, as well as 200 series stainless steels, just to name a few. It is further understood to be within the scope and intent of the present invention to form a sink from other metals and metal alloys besides stainless steel including, but once again, not limited to, aluminum, brass, bronze, cast iron, copper, nickel, as well as from non-metal materials such as terrazzo, glass, plastic, engineered plastic and/or ceramic.

It will be further appreciated by those skilled in the art, that the present seamless undermount stainless steel sink system 10 and installation methodology, which is discussed in greater detail below, may also be utilized to install sinks formed of other metal or metal alloy materials, and/or for undermount installation of a sink to a solid countertop 20 wherein the solid countertop 20 comprises a stone material of construction including, but not limited to, granite, marble, quartz, quartzite, etc.

Figure 3:
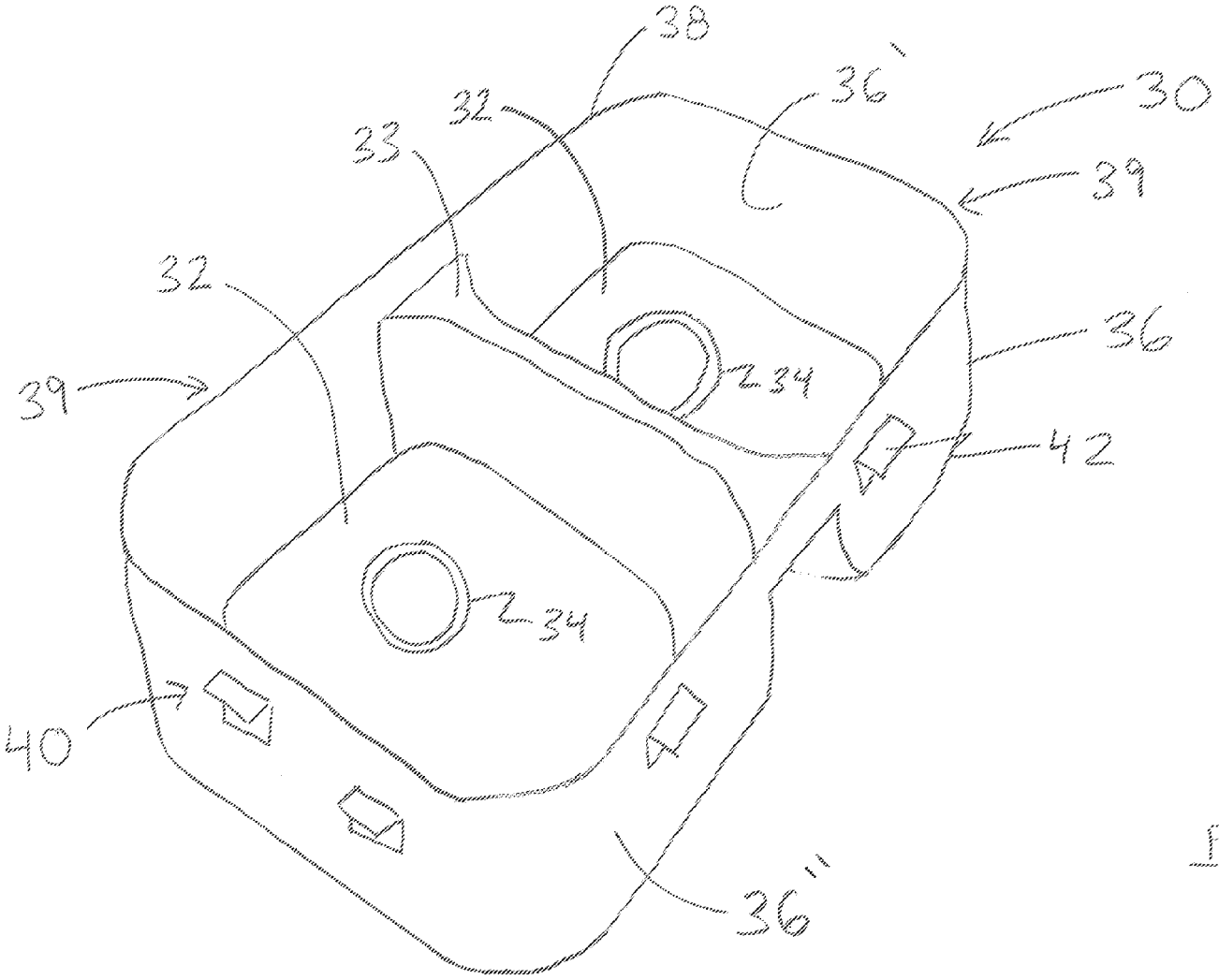
FIG. 3 is a perspective view of one illustrative embodiment of a stainless steel sink and mounting assembly in accordance with the present invention for seamless undermount installation to a solid countertop.

FIG. 3 is illustrative of one embodiment of a stainless steel sink 30 in accordance with the present system 10. The stainless steel sink 30 shown in the embodiment of FIG. 3 comprises a plurality of bowls 32 which are separated by a recessed divider 33. FIG. 3 further illustrates that each bowl 32 comprises a drain 34 disposed through a bottom portion thereof. FIG. 4 is illustrative of another embodiment of a stainless steel sink 30 in accordance with the present invention comprising a single bowl 32 having a single drain 34 disposed therein.

Looking to FIGS. 3, 4 and 4A, a stainless steel sink 30 in accordance with the system 10 in accordance with present invention comprises a sidewall 36 which at least partially defines the bowl or bowls 32. As further illustrated in FIGS. 3, 4 and 4A, the sidewall 36 comprises an inner wall 36' and an outer wall 36", which define a thickness of the sidewall 36 therebetween. As may be seen best in FIGS. 3, 4, and 4A, a stainless steel sink 30 in accordance with the present system 10 further comprises a rimless upper edge 38 which extends around the entirety of the sidewall 36. Similar to the inner periphery 27 along sink mounting aperture 26 of the solid countertop 20, a stainless steel sink 30 in accordance with the present invention comprises an outer periphery 39 which extends along and around the entirety of the sidewall 36 of the stainless steel sink 30 proximate the rimless upper edge 38 thereof. As will be appreciated from the disclosure below, the rimless upper edge 38 of the stainless steel sink 30 is required in order to achieve the seamless undermount of the stainless steel sink 30 to the solid countertop 20 in accordance with the present system 10.

It will be understood and appreciated by those of skill in the art that a stainless steel sink 30 may be fabricated by hand with a rimless upper edge 38, however, mass production of stainless steel sinks 30 commonly employs a process wherein a single piece of stainless steel is drawn and formed into a sink 30 which includes a mounting flange 35 extending around and along the upper portion of a sidewall 36, such as is shown in FIG. 7. As such, and with reference to FIGS. 7 and 7A, a seamless undermount stainless steel sink system 10 in accordance with the present invention may require removal of a mounting flange 35 from the sidewall 36 of stainless steel sink 30 in order to obtain a rimless upper edge 38, such as is shown in FIG. 7A.

As will be appreciated from FIGS. 7 and 7A, and with reference, by way of example, to the PRIOR ART sinks shown in FIGS. 1 and 2, removal of the mounting flange 35 as shown in FIGS. 7 and 7A from either of the PRIOR ART sinks shown in FIGS. 1 and 2 would result in the detachment of the separate bowls of the PRIOR ART sinks from one another. As such, and as previously disclosed with reference to FIG. 3, a seamless undermount stainless steel sink system 10 in accordance with at least one embodiment of the present invention comprises a stainless steel sink 30 having a recessed divider 33, specifically to permit a mounting flange 35 to be removed such as is shown in FIGS. 7 and 7A, while maintaining a plurality of bowls 32 attached to one another, once again, as shown in FIG. 3.

As shown throughout the figures, a seamless undermount stainless steel sink system 10 in accordance with the present invention further comprises a mounting assembly generally shown as 40. A mounting assembly 40 comprises at least one mounting bracket 42, however, in at least one embodiment, a mounting assembly 40 in accordance with the present system 10 comprises a plurality of mounting brackets 42, such as is shown in the illustrative embodiments of FIGS. 3 and 4. In at least one embodiment (not shown), a single mounting bracket may be disposed around the entirety of the sidewall 36 of the stainless steel sink 30 in accordance with the present invention. By way of example, after removal of a mounting flange 35 from a stainless steel sink 30, the sink 30 is positioned through the top of the mounting flange 35 and the mounting flange 35 is secured to the sidewalls 36, thus providing a single mounting bracket 42 which extends along and around the entire sidewall 36 of the stainless steel sink 30.

Alternatively, and again as shown in FIGS. 3 and 4, a mounting assembly 40 comprises a plurality of mounting brackets 42 which are attached to an outer wall 36" of a sidewall 36 of a stainless steel sink 30. More in particular, the plurality of mounting brackets 42 are positioned in a spaced apart arrangement around the sidewall 36 of the stainless steel sink 30, and are attached thereto in order to provide a plurality of points for securing the stainless steel sink 30 to the underside of a solid countertop 20 along a bottom surface 24 thereof.

Figure 6:
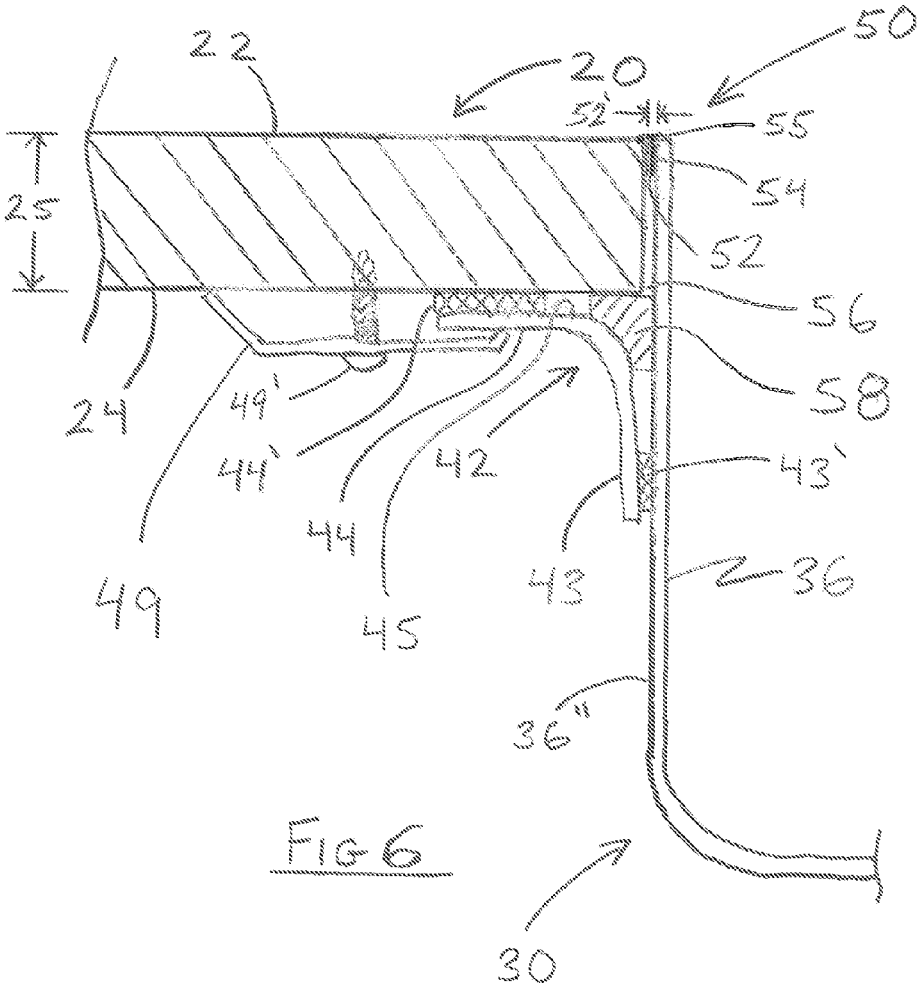
FIG. 6 is a partial cross-sectional view of the stainless steel sink mounted to the solid countertop in accordance with the embodiment of FIGS. 4 and 5 of present invention.
Figure 6A:
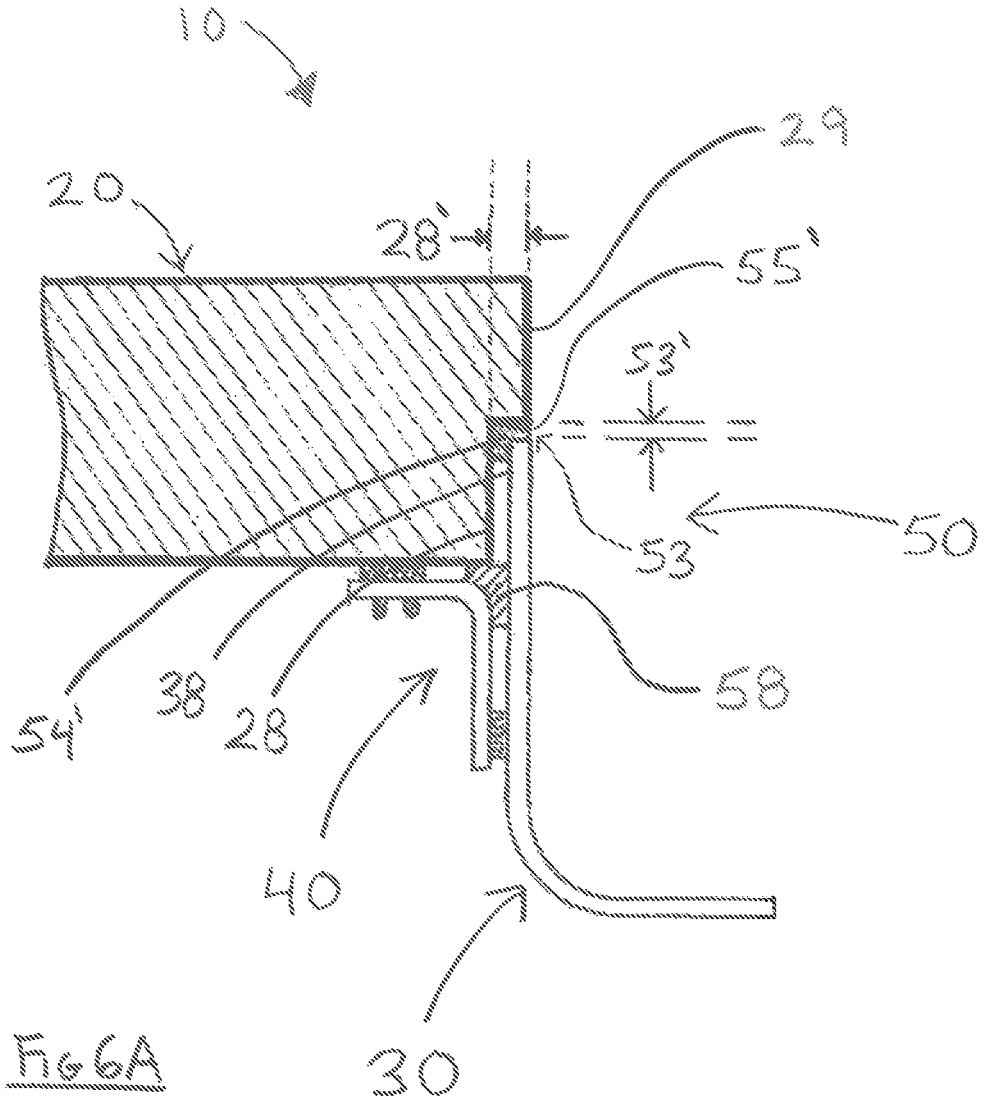
FIG. 6A is a partial cross-sectional view of the stainless steel sink mounted to the solid countertop in accordance with the embodiment of FIGS. 4A and 5A of present invention.
Figure 6B:
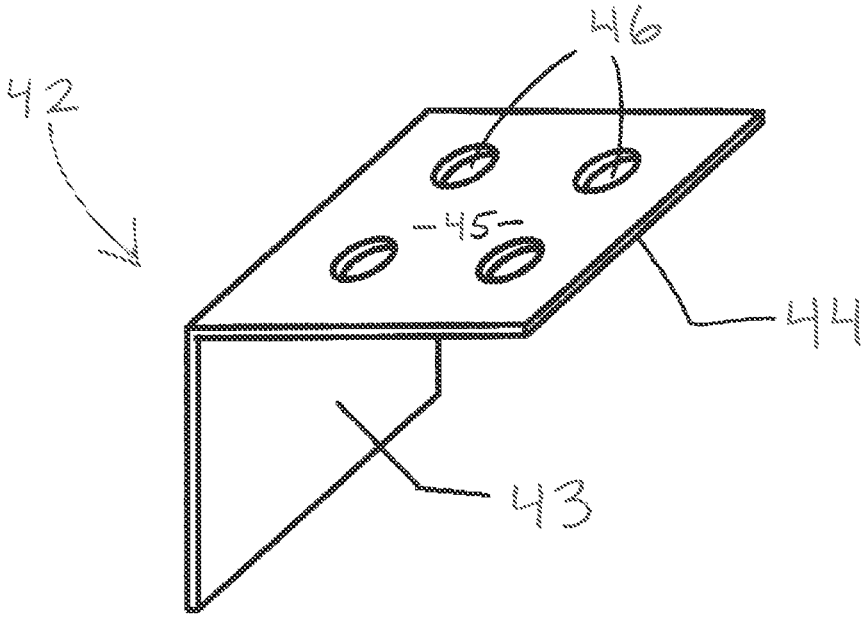
FIG. 6B is a perspective view of one illustrative embodiment of a mounting bracket in accordance with the present invention.

FIG. 6B is illustrative of just one embodiment of a mounting bracket 42 in accordance with the present invention. As shown in the embodiment of FIG. 6B, the mounting bracket 42 includes a sink flange 43 which is disposed at a substantially right angle to a countertop flange 44. FIG. 6B further illustrates that a countertop flange 44 comprises a countertop flange surface 45 which, as discussed in greater detail below, is positioned adjacent to bottom surface 24 of the solid countertop 20 in order to secure the stainless steel sink 30 to the solid countertop 20. In addition, countertop flange 44, in at least one embodiment, includes one or more countertop flange apertures 46 such as shown again in FIG. 6B. The countertop flange aperture(s) 46 facilitate securing the mounting bracket 42 to the bottom surface 24 of the solid countertop 20, as discussed in further detail below.

Figure 11:
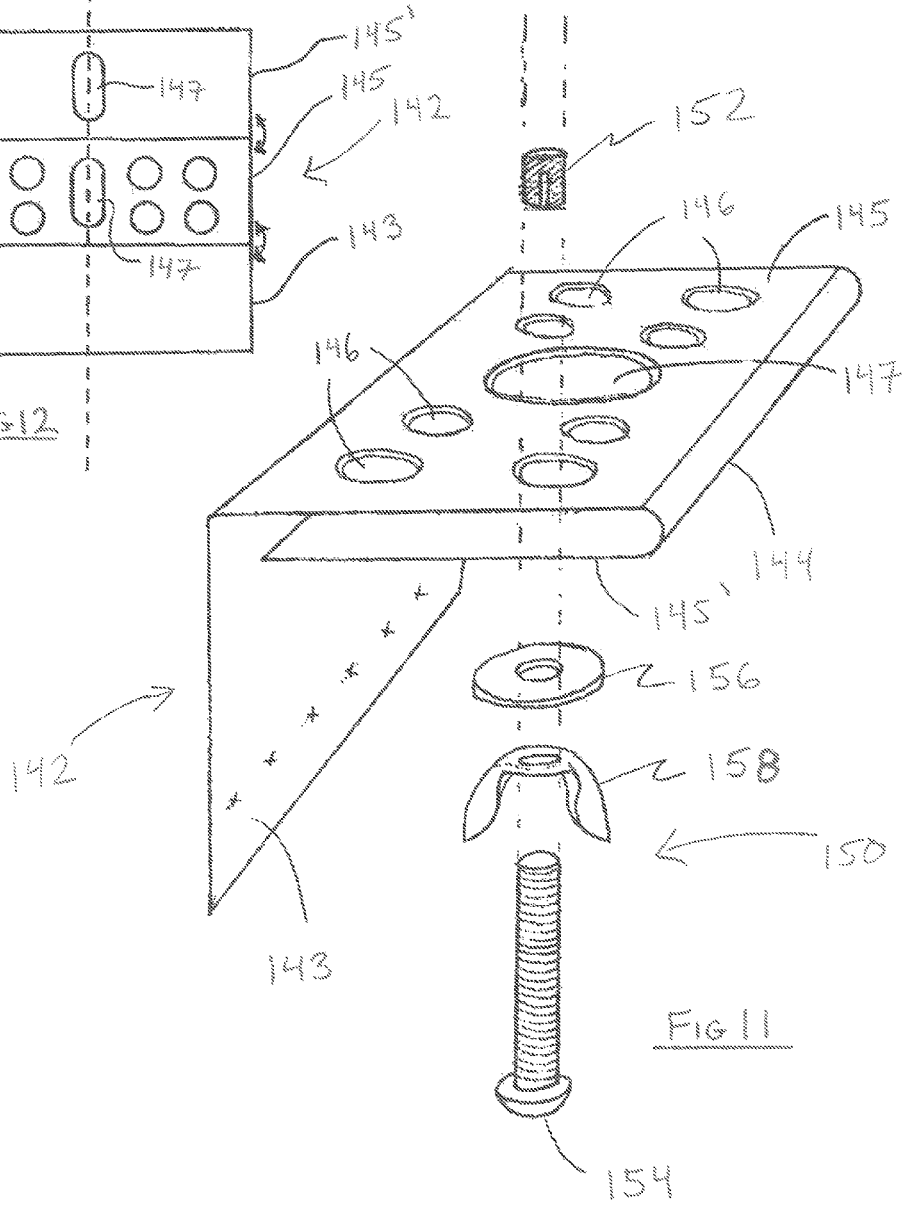
FIG. 11 is a perspective view of one illustrative alternate embodiment of a mounting bracket and fastener assembly in accordance with the present invention.

FIG. 11 is illustrative of one alternate embodiment of a mounting bracket 142 in accordance with the present invention. As shown in the embodiment of FIG. 11, the mounting bracket 142 includes a sink flange 143 which is disposed at a substantially right angle to a countertop flange 144. FIG. 11 further illustrates that the countertop flange 144 comprises a countertop flange surface 145 which, as discussed in greater detail below, is positioned adjacent to bottom surface 24 of the solid countertop 20 in order to secure the stainless steel sink 30 to the solid countertop 20. In addition, countertop flange 144, in at least one embodiment, includes one or more countertop flange apertures 146 through the countertop flange surface 145, such as shown in FIG. 11. The countertop flange aperture(s) 146 facilitate securing the mounting bracket 142 to the bottom surface 24 of the solid countertop 20 with adhesives, as discussed in further detail below.

An adjustable countertop flange 145' underlies the countertop flange surface 145 and is disposed an offset distance below the countertop flange surface 145, such as is shown in FIG. 11. The adjustable countertop flange 145' is positionable closer to or farther from the countertop flange surface 145 when mounted to the bottom surface 24 of the solid countertop 20, such as by fastener assembly 150, discussed below. As such, the adjustable countertop flange 145' allows for vertical adjustment of a stainless steel sink 30 relative to a solid countertop 20. More in particular, by adjusting the position of an adjustable countertop flange 145' relative to a countertop flange surface 145, a rimless upper edge 38 of a stainless steel sink 30 may be more precisely positioned relative to a top surface 22 of a solid countertop 20 adjacent a sink mounting aperture 26.

It will further be appreciated that the adjustable countertop flange 145' also serves to retain the adhesive utilized to mount the mounting bracket 142 to the bottom surface 24 of a solid countertop 20 when a stainless steel sink 30 is installed after the solid countertop 20 is already in place, i.e., when the stainless steel sink 30 is installed from underneath the solid countertop 20.

Figure 12:
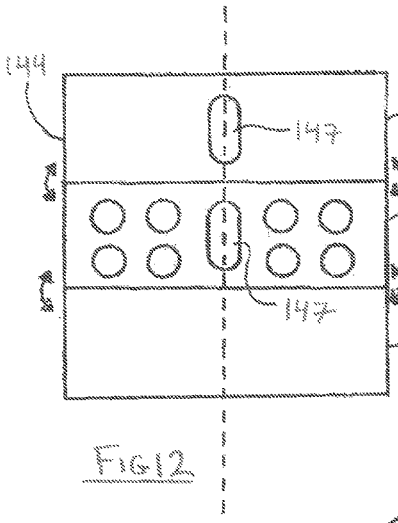
FIG. 12 is a plan view of the alternate embodiment of the mounting bracket of FIG. 11 before being folded into an operative configuration.

As shown best in FIG. 12, which is illustrative of a mounting bracket 142 before it is folded into an operative configuration, each of the countertop flange surface 145 and the adjustable countertop flange 145' comprises a mounting fastener aperture 147 disposed therethrough. More in particular, each mounting fastener aperture 147 is positioned such the mounting fastener aperture 147 through each of the countertop flange surface 145 and the adjustable countertop flange 145' are substantially aligned with one another when the mounting bracket 142 is folded into an operative configuration, such as is shown best in FIG. 11.

FIG. 11 further illustrates one embodiment of a fastener assembly 150 in accordance with the present invention. In at least one embodiment, the fastener assembly 150 comprises an insert nut 152. The insert nut 125 is embedded into a bottom surface 24 of a solid countertop 20. In at least one embodiment, a hole is countersunk into the bottom surface 24 of the solid countertop 20, and the insert nut 152 is mounted therein utilizing an appropriate adhesive. The insert nut 152 includes internal threads dimensioned and configured to receive at least a portion of a fastener 154 therein in a secure threaded configuration.

In at least one further embodiment, such as is shown in FIG. 11, a fastener assembly 150 in accordance with the present invention further comprises a washer 156 around a portion of the fastener 154 and a wing nut 158 threadedly attached to the fastener 158. As such, once a mounting bracket 142 is mounted to a bottom surface 24 of a solid countertop 20, a portion of a fastener 154 may be threaded into an insert nut 152 through corresponding and aligned fastener apertures 147. Further, a wing nut 158 is attached along a shaft of the fastener 154 and a washer 156 is disposed between the wing nut 158 and a portion of an adjustable countertop flange 145' is utilized to move the adjustable countertop flange 145' closer to or further from a countertop flange surface 145, as the wing nut 158 is positioned up or down along the shaft of the fastener 154, respectively.

FIG. 6 presents a partial cross-section view of one illustrative embodiment of a stainless steel sink 30 seamlessly mounted to a solid countertop 20 in accordance with the present invention. As may be seen from FIG. 6, a mounting bracket 42 comprises a sink flange 43 and a countertop flange 44 as previously disclosed, wherein the sink flange 43 is attached to an outer wall 36" of the sidewall 36 via a sink interconnect 43'. It will be appreciated by those of skill in the art that a sink interconnect 43' may comprise any of a variety of means for securely attaching a sink flange 43 to the outer wall 36" of a stainless steel sink 30. As one example, the sink interconnect 43' comprises a weld between the sink flange 43 and the outer wall 36" of the sidewall 36. As another example, an appropriate adhesive, such as, by way of example only, an epoxy or a polyester resin, is utilized as sink interconnect 43' in order to securely attach a sink flange 43 to the outer wall 36" of the sidewall 36. In yet another embodiment, the sink interconnect 43' comprises a mechanical fastener such as a screw, a bolt, a rivet, etc., in order to securely attach the sink flange 43 to the outer wall 36" of the stainless steel sink 30. It will further be appreciated that a combination of one or more sink interconnects 43' may be employed in order to further assure that the sink flange 43 is securely attached to the stainless steel sink 30.

Similarly, a countertop interconnect 44' is utilized to securely attach a countertop flange 44 to a portion of the bottom surface 24 of the solid countertop 20. As before, with regard to sink interconnect 43', the countertop interconnect 44' may comprise any of a variety of appropriate attachment means. In at least one embodiment, a countertop interconnect 44' comprises an epoxy resin in order to securely attach the countertop flange 44 to the bottom surface 24 the solid countertop 20, an in one further embodiment, a two-part epoxy resin is utilized as a countertop interconnect 44'. In such an embodiment, the epoxy resin is permitted to flow through countertop flange aperture(s) 46 and onto the underside of the countertop flange 44 to further facilitate securely attaching the countertop flange 44 to the bottom surface 24 of the solid countertop 20. In another embodiment, a mechanical fastener such as a masonry screw may be utilized as a countertop interconnect 44' in order to securely attach countertop flange 44 to the bottom surface 24 of the solid countertop 20. As will be appreciated by those skilled in the art, a combination of an adhesive and a mechanical fastener may be utilized as a countertop interconnect 44' in order to further assure that the countertop flange 44 is securely attached to the bottom surface 24 of the solid countertop 20.

As will also be appreciated by those of skill in the art, the alternate embodiment of a mounting bracket 142, as discussed above, may be mounted to a portion of a stainless steel sink 30 and a bottom surface 24 of a solid countertop 20 in a substantially similar manner.

In at least one alternate embodiment, mounting assembly 40 may comprise a mounting clip 49 which is secured into the bottom surface 24 of the solid countertop 20 via fastener 49'. As shown in FIG. 6, a portion of the mounting clip 49 extends over a portion of the countertop flange 44 in order to further assure that the countertop flange 44 remains securely attached to the bottom surface 24 of the solid countertop 20.

With reference once again to FIG. 4, each mounting bracket 42 is securely attached to the outer wall 36" of the stainless steel sink 30 at a predetermined mounting depth 48. More in particular, and again as shown in FIG. 4, the countertop flange surface 45 of each mounting bracket 42 is disposed at a predetermined mounting depth 48 from the rimless upper edge 38 of the stainless steel sink 30. More in particular, a predetermined mounting depth 48 corresponds to the thickness 25 of the solid countertop 20. Present industry standards dictate that solid granite or marble countertops are provided with a thickness of either two centimeters or three centimeters, while porcelain countertops typically have a thickness in a range of about six to twelve millimeters. In one embodiment, the countertop flange surface 45 of the mounting bracket 42 is positioned at a predetermined depth 48 of eighteen millimeters below the rimless upper edge 38 of the stainless steel sink 30, for installation to a standard two centimeter thick solid countertop 20. In an embodiment of the present system 10 comprising a three centimeter thick solid countertop 20, the countertop flange surface 45 of the mounting bracket 42 is positioned at a predetermined depth 48 of twenty-eight millimeters below the rimless upper edge 38 of the stainless steel sink 30.

In at least one further embodiment, the predetermined mounting depth 48 comprises a tolerance of plus or minus one millimeter relative to the thickness 25 of the solid countertop 20. That is to say, the predetermined mounting depth 48 at which the countertop flange surface 45 is positioned below the rimless upper edge 38 of the stainless steel sink 30 when the mounting flange is securely attached to the outer wall 36" of the stainless steel sink 30 must be no more nor no less than one millimeter of the thickness 25 of the solid countertop 20. As such, when the stainless steel sink 30 is mounted to the solid countertop 20 from below, the rimless upper edge 38 will be within one millimeter of the top surface 22 of the solid countertop 20 which, as will be appreciated, permits the seamless installation of stainless steel sink 30 in accordance with the present system 10.

Furthermore, when the rimless upper edge 38 of a stainless steel sink 30 is positioned through a sink mounting aperture 26 of the solid countertop 20, an upper interface 52 is formed between the inner periphery 27 of a sink mounting aperture 26 and the outer periphery 39 along the rimless upper edge 38. In at least one embodiment of the present invention, an upper interface tolerance 52' must be one millimeter or less. Stated otherwise, the distance between the inner periphery 27 of a sink mounting aperture 26 and outer periphery 39 along the rimless upper edge 38 is one millimeter or less when a stainless steel sink 30 is mounted through a sink mounting aperture 26 of a solid countertop 20 in accordance with the present system 10.

As illustrated in FIG. 6A, in at least one embodiment, the rimless upper edge 38 of a stainless steel sink 30 is positioned into a receiving channel 28 of a sink mounting aperture 26 of the solid countertop 20. A channel interface 53 is formed between the rimless upper edge 38 of said stainless steel sink 30 and the finished periphery surface 29 of the solid countertop 20. In at least one embodiment of the present invention, a channel interface tolerance 53' must be one millimeter or less. Stated otherwise, the distance between the rimless upper edge 38 of the stainless steel sink 30 and the finished periphery surface 29 of the inner periphery 27 is one millimeter or less when a stainless steel sink 30 is mounted in a receiving channel 28 of a solid countertop 20 in accordance with the present system 10.

Looking again to FIG. 6, the seamless undermount stainless steel sink system 10 in accordance with the present invention further comprises a sealing assembly 50. The sealing assembly 50 includes an upper seal 54 which is applied along and around the upper interface 52 between the inner periphery 27 of sink mounting aperture 26 and the outer periphery 39 of the outer wall 36" of the stainless steel sink 30. In one embodiment, the upper seal 54 comprises an epoxy glue or an epoxy resin which will securely bond to both the solid countertop 20 and the stainless steel sink 30, thereby providing an essential impervious seal over and along the upper interface 52. In an alternate embodiment, the upper seal 54 comprises a polyester resin to securely bond to both the solid countertop 20 and the stainless steel sink 30, once again, providing an essential impervious seal over and along the upper interface 52. In further embodiments, the upper seal 54 comprises a polyester resin, a polyurethane resin, an epoxy resin, an acrylic casting resin, or combinations thereof. As will be appreciated, the upper seal 54 will serve to prevent water, moisture, bacteria, food, and/or other debris such as may be encountered in a sink environment from entering into the area between the solid countertop 20 and the stainless steel sink 30, in particular, into and through the upper interface 52 therebetween.

In at least one further embodiment, a top coat 55 is applied to the upper seal 54 wherein the top coat 55 is selected based on the color of the top surface 22 of the solid countertop 20 so as to camouflage the presence of the upper seal 54. The top coat 55, in at least one embodiment, comprises a color matching epoxy or polyester resin selected to simulate the color of the top surface 22 of the solid countertop 20. In yet one further embodiment, the upper seal 54 and/or top coat 55 may be further finished by sanding, buffing, etc., so as to further camouflage the presence of the upper seal 54, thereby enhancing the overall seamless appearance between the stainless steel sink 30 and the solid countertop 20 along the upper seal 54, such as is shown best in FIG. 5.

With reference to the illustrative embodiment of FIG. 6A, a sealing assembly 50 in accordance with the seamless undermount stainless steel sink system 10 of the present invention comprises a channel seal 54' which is applied along and around the channel interface 53 between the finished periphery surface 29 of the sink mounting aperture 26 and the rimless upper edge 38 of the stainless steel sink 30. In one embodiment, as before, the channel seal 54' comprises an epoxy glue or an epoxy resin which will securely bond to both the solid countertop 20 and the stainless steel sink 30, thereby providing an essential impervious seal over and along the channel interface 53. In an alternate embodiment, the channel seal 54' comprises a polyester resin to securely bond to both the solid countertop 20 and the stainless steel sink 30, once again, providing an essential impervious seal over and along the channel interface 53. In further embodiments, the channel seal 54' comprises a polyester resin, a polyurethane resin, an epoxy resin, an acrylic casting resin, or combinations thereof. As will be appreciated, the channel seal 54' will serve to prevent water, moisture, bacteria, food, and/or other debris such as may be encountered in a sink environment from entering into the area between the solid countertop 20 and the stainless steel sink 30, in particular, into and through the channel interface 53 therebetween.

In one further embodiment, a top coat 55' is applied to the channel seal 54' wherein the top coat 55' is selected based on the color of the finished periphery surface 29 of the solid countertop 20, so as to camouflage the presence of the channel seal 54'. The top coat 55', in at least one embodiment, comprises a color matching epoxy or polyester resin selected to simulate the color of the solid countertop. In yet one further embodiment, the channel seal 54' and/or top coat 55' may be further finished by sanding, buffing, etc., so as to further camouflage the presence of the channel seal 54', thereby enhancing the overall seamless appearance between the stainless steel sink 30 and the solid countertop 20 along the channel seal 54', such as is shown best in FIG. 5A.

In at least one embodiment, a sealing assembly 50 in accordance with the present invention further comprises a lower seal 58, such as is shown in FIGS. 6 and 6A. A lower seal 58 comprises a waterproof silicone adhesive or similar material which is utilized to seal a lower interface 56 between the outer wall 36" of the stainless steel sink 30 and the bottom surface 24 of the solid countertop 20.

Figure 8:
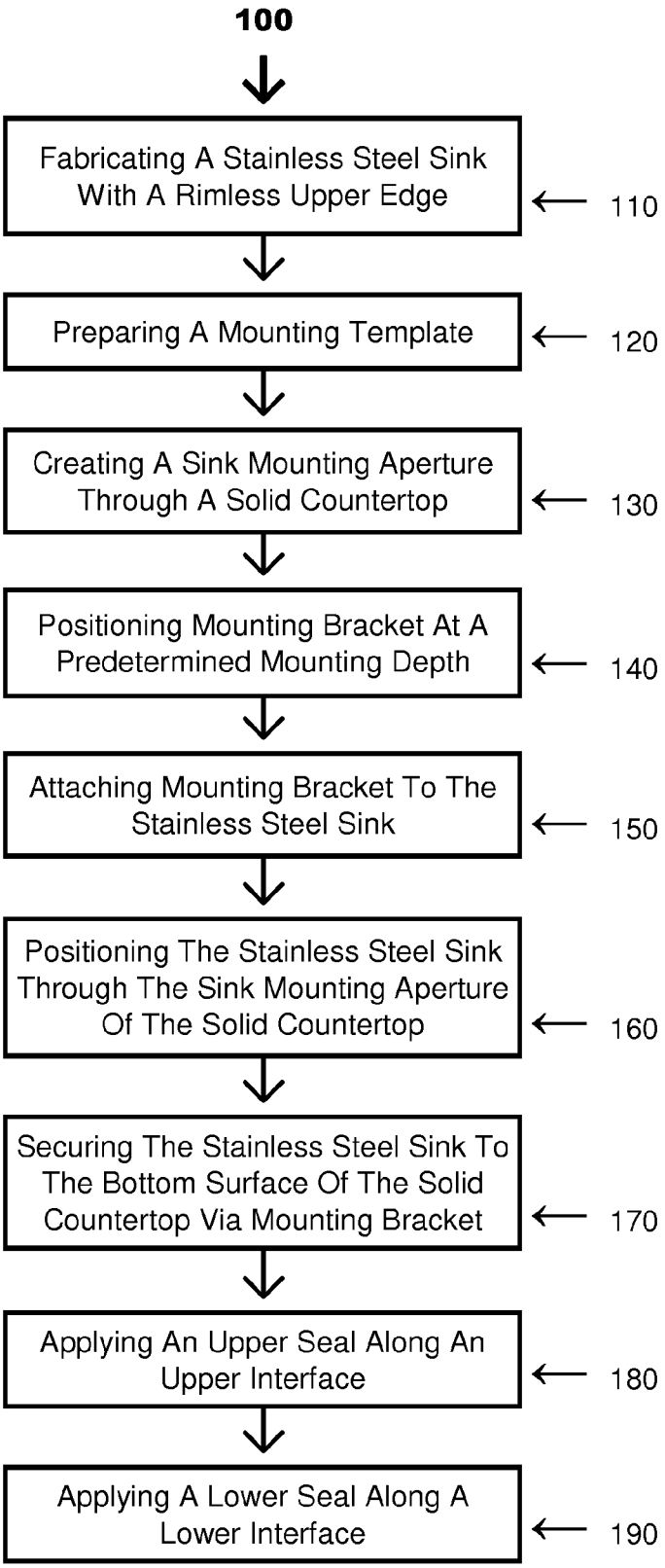
FIG. 8 is a block diagram illustrative of one method for seamless undermount installation of a stainless steel sink to a solid countertop in accordance with the present invention.
Figure 9:
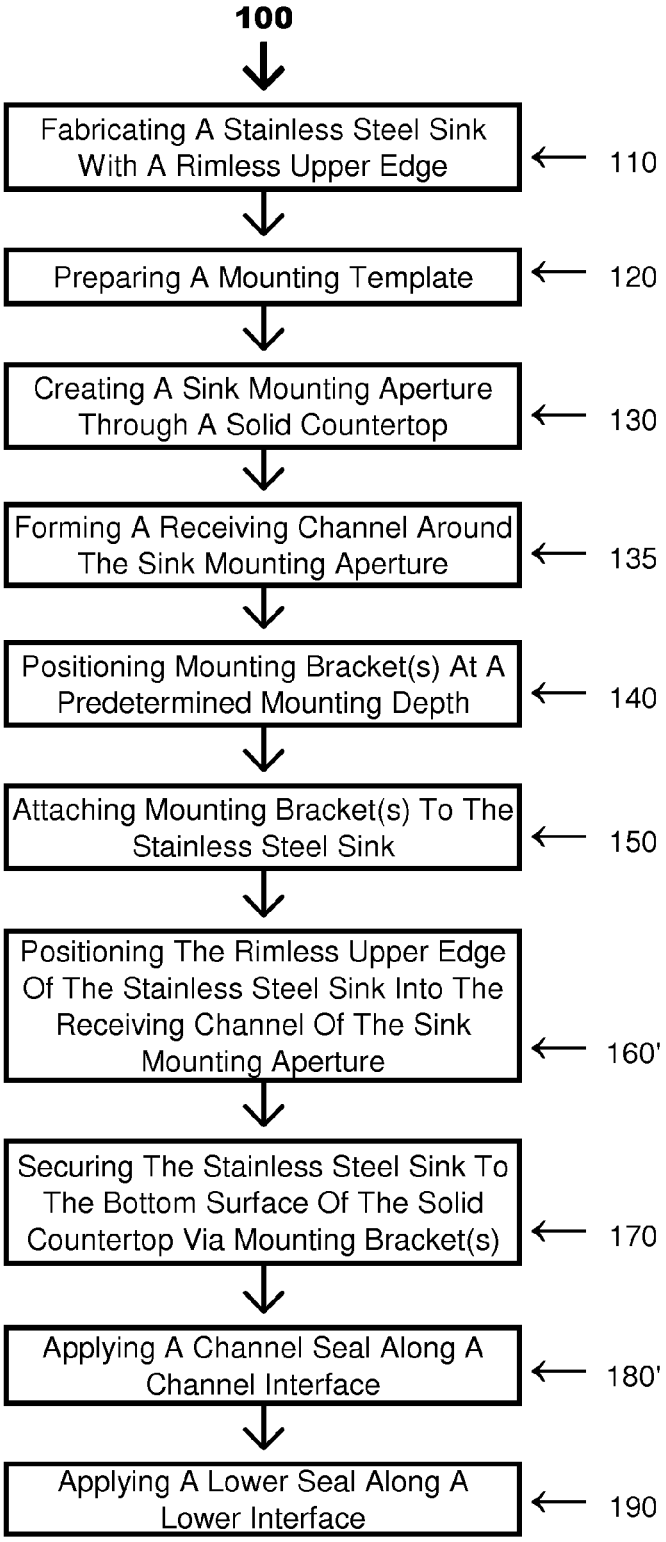
FIG. 9 is a block diagram illustrative of an alternate method for seamless undermount installation of a stainless steel sink to a solid countertop in accordance with the present invention.
Figure 10:
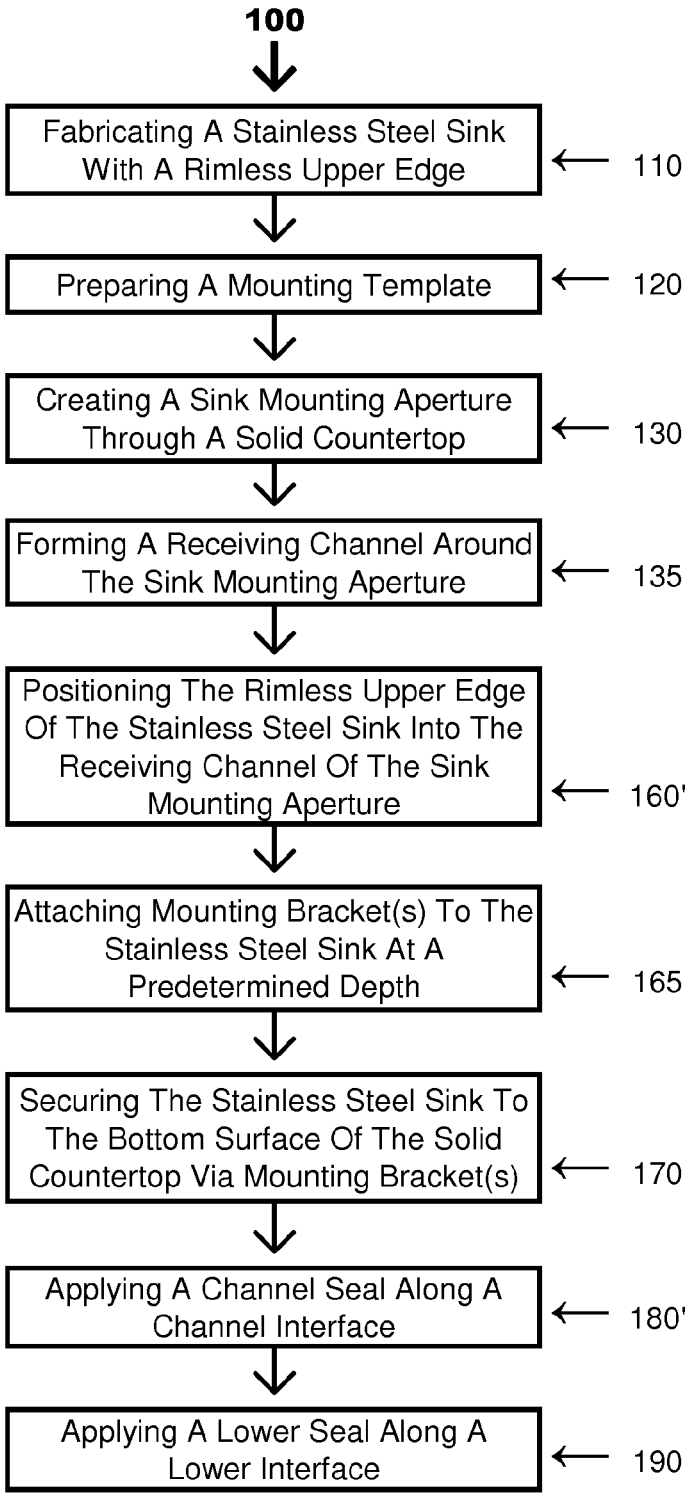
FIG. 10 is a block diagram illustrative of yet another method for seamless undermount installation of a stainless steel sink to a solid countertop in accordance with the present invention.

As previously stated, the present invention further comprises a method for seamless undermount installation of a stainless steel sink to a solid countertop, which is generally as shown as at 100 in FIGS. 8, 9 and 10.

As shown in illustrative embodiments of FIGS. 8, 9, and 10, the present method 100 includes fabricating a stainless steel sink with a rimless upper edge 110, wherein the rimless upper edge at least partially defines an outer periphery therearound. As previously stated, this may be accomplished via hand fabrication techniques, wherein the sink as fabricated is rimless. Alternatively, when a stainless steel sink is fabricated by drawing and/or forming via mass production techniques, a mounting flange must be removed from the top of the sink, such as via cutting via mechanical of laser cutter equipment.

In at least one embodiment, fabricating a stainless steel sink with a rimless upper edge 100 requires that the front and rear sidewalls of the sink be essentially straight, with deviations long the sidewalls of less than one-half millimeter inward or outward. In addition, the rimless upper edge must not have deviations of more than one millimeter along and around its entire length. That is to say, if the sink is placed upside down on a completely flat surface, there must not be more than a one millimeter gap between the rimless upper edge of the sink and the flat surface at any point between the upper edge and the surface.

The present method 100 in accordance with FIGS. 8, 9, and 10 further comprises preparing a mounting template 120 based on the outer periphery of the rimless upper edge of the stainless steel sink. The mounting template may be prepared 120 by turning the sink upside down on a template medium, such as tracing paper, cardboard, etc. In at least one embodiment, the sink may be placed upside down directly on the solid countertop itself, and its outline traced directly thereon to facilitate preparing the mounting template 120.

Once a mounting template has been applied to a surface of the solid countertop, the present method further provides for creating a sink mounting aperture through the solid countertop 130, wherein the mounting aperture extends between a top surface and a bottom surface of the solid countertop based on the mounting template. As previously noted above, in at least one embodiment the sink mounting aperture comprises an inner periphery configured to receive the outer periphery of the rimless upper edge of the stainless steel sink therethrough.

In accordance with the illustrative embodiments of FIGS. 9 and 10, the present method further comprises forming a receiving channel along and around the sink mounting aperture 135. In at least one embodiment, the receiving channel extends around the inner periphery of the sink mounting aperture, and in at least one further embodiment, and as shown in the illustrative embodiment of FIG. 4A, the receiving channel extends around and along the lower portion of substantially the entire inner periphery of the sink mounting aperture. As previously indicated, the receiving channel at least partially defines a channel height and a channel width, cooperatively dimensioned to receive an outer periphery of the stainless steel sink therein.

As shown in the illustrative embodiments of FIGS. 8 and 9, the present method further includes positioning at least one mounting bracket at a predetermined mounting depth 140 below the rimless upper edge of the stainless steel sink. In at least one embodiment, the mounting bracket has a sink flange and a countertop flange, wherein the countertop flange comprises a countertop flange surface which is positioned at the predetermined mounting depth below the rimless upper edge of the stainless steel sink.

The illustrative embodiments of the present method 100 as shown in FIGS. 8 and 9 next comprise attaching at least one mounting bracket to the stainless steel sink 150, and in one further embodiment, the present method comprises attaching a plurality of mounting brackets to the stainless steel sink 150, wherein each mounting bracket is positioned and attached to the stainless steel sink at the predetermined mounting depth below the rimless upper edge. A sink interconnect, as disclosed above, is utilized to securely attach the mounting bracket(s) to the stainless steel sink, in accordance with at least one embodiment of the present method 100.

Once the mounting bracket(s) are securely attached to the stainless steel sink at the predetermined mounting depth, the method 100 of the present invention in accordance with the embodiment of FIG. 8 further comprises positioning the rimless upper edge of the stainless steel sink through the sink mounting aperture of the solid countertop 160, such that the countertop flange surface is adjacent to the bottom surface of the solid countertop, and the rimless upper portion of the stainless steel sink is essentially flush with the top surface of the stainless steel sink. The present method 100 further provides for securing the stainless steel sink to the bottom surface of the solid countertop via at least one mounting bracket 170. Of course, in one further embodiment of the present invention, the method 100 provides for securing the stainless steel sink to the bottom surface of the solid countertop via a plurality of mounting brackets 170. As before, a countertop interconnect is utilized to secure the stainless steel sink to the solid countertop in accordance with at least one embodiment of the present invention.

Turning to the illustrative embodiment of FIG. 9, once the mounting bracket(s) are securely attached to the stainless steel sink at the predetermined mounting depth, the present method 100 comprises positioning the rimless upper edge of the stainless steel sink into the receiving channel in the sink mounting aperture of the solid countertop 160', such that the countertop flange surface is adjacent to the bottom surface of the solid countertop and, more importantly, the rimless upper edge of the stainless steel sink is adjacent to the finished periphery surface of the inner periphery. In at least one embodiment, the distance between the rimless upper edge of the stainless steel sink and the finished periphery surface of the inner periphery is less than the channel interface tolerance. As in the embodiment of the present method 100 as shown in FIG. 8, the method 100 in accordance with the embodiment of FIG. 9 further provides for securing the stainless steel sink to the bottom surface of the solid countertop via at least one mounting bracket 170. Of course, in one further embodiment of the present invention, the method 100 provides for securing the stainless steel sink to the bottom surface of the solid countertop via a plurality of mounting brackets 170. As before, a countertop interconnect is utilized to secure the stainless steel sink to the solid countertop in accordance with at least one embodiment of the present invention.

Looking next to the illustrative embodiment of the present method 100 in accordance with FIG. 10, it is noted that the step of positioning at least one mounting bracket at a predetermined mounting depth 140 below the rimless upper edge of the stainless steel sink is not present. Rather, and before attaching mounting bracket(s) to the stainless steel sink, the illustrative method of FIG. 10 comprises positioning the rimless upper edge of the stainless steel sink into the receiving channel in the sink mounting aperture of the solid countertop 160', such that the rimless upper edge of the stainless steel sink is adjacent the finished periphery surface of the inner periphery of the sink mounting aperture. Next, and further in accordance with the alternative method 100 of FIG. 10, once the rimless upper edge of the stainless steel sink is adjacent the finished periphery surface of the inner periphery, the method 100 comprises attaching one or more mounting brackets to the stainless steel 165. It will be appreciated that the mounting bracket(s) will necessarily be positioned at a predetermined depth so long as the rimless upper edge of the stainless steel sink is adjacent the finished periphery surface of the inner periphery of the solid countertop, and the countertop flange surface is adjacent to the bottom surface of the solid countertop. Once the one or more mounting brackets are attached to the stainless steel sink, the alternative method 100 of FIG. 10 proceeds as in the case of the embodiments of FIGS. 8 and 9, namely, securing the stainless steel sink to the bottom surface of the solid countertop via one or more mounting brackets 170. As before, a countertop interconnect is utilized to secure the stainless steel sink to the solid countertop in accordance with at least one embodiment of the present invention.

The method 100 for seamless undermount installation of a stainless steel sink to a solid countertop in accordance with the embodiment of FIG. 8 further comprises applying an upper seal along an upper interface 180 between the outer periphery of the rimless upper edge of the stainless steel sink and the inner periphery of the sink mounting aperture through the solid countertop. As noted above, in at least one embodiment, the upper seal may comprise a polyester resin, and in one further embodiment, the upper seal may comprise a color matched polyester resin. In at least one embodiment, the upper seal prevents water, moisture, bacteria, and debris from entering between the rimless upper edge of the stainless steel sink and the top surface of the solid countertop.

The top surface of the solid countertop may be masked around the inner periphery of the sink mounting aperture prior to applying the upper seal, so as to avoid unwanted application of the resin to the countertop itself. In one further embodiment, a top coat is applied to the upper seal in order to camouflage its presence, and in one further embodiment, the upper seal may be finished, such as via sanding, buffing, and/or polishing, so as to even further conceal the presence of the upper seal at the seamless interface between the stainless steel sink and the solid countertop.

Alternatively, the method for seamless undermount installation of a stainless steel sink to a solid countertop 100 in accordance the illustrative embodiments of FIGS. 9 and 10 further comprises applying a channel seal along a channel interface 180' between the rimless upper edge of the stainless steel sink and the finished periphery surface of the inner periphery of the sink mounting aperture through the solid countertop. As noted above, in at least one embodiment, the channel seal may comprise a polyester resin, and in one further embodiment, the channel seal may comprise a color matched polyester resin. In at least one embodiment, the channel seal prevents water, moisture, bacteria, and debris from entering between the stainless steel sink and the solid countertop.

The finished periphery surface of the inner periphery of the sink mounting aperture may be masked along the inner periphery of the sink mounting aperture prior to applying the channel seal, so as to avoid unwanted application of the resin to the finished periphery surface. In one further embodiment, a top coat is applied to the channel seal in order to camouflage its presence, and in one further embodiment, the top coat and/or channel seal may be finished, such as via sanding, buffing, and/or polishing, so as to even further conceal the presence of the channel seal at the seamless interface between the stainless steel sink and the solid countertop.

In at least one embodiment, the method for seamless undermount installation of a stainless steel sink to a solid countertop 100 includes applying a lower seal along a lower interface 190, such as is shown in the illustrative embodiments of FIGS. 8, 9, and 10, wherein the lower seal comprises a substantially waterproof material, such as silicone, to prevent water or moisture from entering a lower interface between the outer wall of the stainless steel sink and the bottom surface of the solid countertop, as previously disclosed hereinabove.

As will be appreciated from the foregoing, the present method 100 comprises steps which may be performed by different parties at different locations. Specifically, steps 110 through 150 may be performed at a factory which manufactures stainless steel sinks and/or solid countertops in accordance with the present invention, while steps 160 through 190 may be performed by an individual or contractor who physically installs a stainless sink manufactured in accordance with the present invention in an end user's home or business.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A seamless undermount stainless steel sink system comprising: a solid countertop having a top surface and a bottom surface, said top surface and said bottom surface at least partially defining a thickness therebetween, a sink mounting aperture disposed through said solid countertop, said sink mounting aperture having an inner periphery, a stainless steel sink comprising a sidewall which partially forms at least one bowl, a rimless upper edge along and around said sidewall of said stainless steel sink, wherein an outer periphery is defined around said rimless upper edge, said rimless upper edge of said stainless steel sink is disposed adjacent and substantially coplanar with said top surface of said solid countertop when said stainless steel sink is mounted through said bottom surface of said solid countertop; a mounting assembly comprising at least one mounting bracket attached to a portion of said stainless steel sink, said mounting bracket including a countertop flange having a countertop flange surface and an adjustable countertop flange, said mounting bracket positioned a predetermined mounting depth below said rimless upper edge of said stainless steel sink, an upper interface formed between said rimless upper edge of said stainless steel sink and said top surface of said solid countertop, and an upper seal disposed in said upper interface between said rimless upper edge of said stainless steel sink and said top surface of said solid countertop.

2. The system as recited in claim 1 wherein said upper seal forms a moisture resistant barrier along said upper interface.

3. The system as recited in claim 2 wherein said upper seal prevents water, bacteria, or debris from entering between said rimless upper edge of said stainless steel sink and said solid countertop.

4. The system as recited in claim 2 wherein said upper seal comprises an epoxy resin.

5. The system as recited in claim 4 wherein said upper seal further comprises a top coat, said top coat selected to correspond to a color of said top surface of said solid countertop in order to camouflage its presence.

6. The system as recited in claim 1 wherein said countertop flange is secured to said bottom surface of said solid countertop via a countertop interconnect.

7. The system as recited in claim 6 wherein said countertop interconnect comprises at an epoxy glue.

8. The system as recited in claim 1 wherein said solid countertop is comprises granite.

9. The system as recited in claim 1 wherein said solid countertop comprises marble.

10. The system as recited in claim 1 wherein said mounting assembly comprising a plurality of mounting brackets interconnected to a portion of said stainless steel sink, wherein each of said plurality of mounting brackets includes a countertop flange having a countertop flange surface, each said countertop flange surface positioned at said predetermined mounting depth below said rimless upper edge of said stainless steel sink.

11. The system as recited in claim 10 wherein each said countertop flange surface is substantially perpendicular to said sidewall of said stainless steel sink.

12. A method for seamless undermount installation of a stainless steel sink to a solid countertop, the method comprising:

fabricating the stainless steel sink with a rimless upper edge defining an outer periphery therearound, preparing a mounting template based on the outer periphery of the rimless upper edge of the stainless steel sink, creating a sink mounting aperture through the solid countertop between a top surface and a bottom surface based on the mounting template, wherein the sink mounting aperture comprises an inner periphery dimensioned to receive the outer periphery of the rimless upper edge of the stainless steel sink therein such that the rimless upper edge of the stainless steel sink is disposed adjacent and substantially coplanar with the top surface of the solid countertop when the stainless steel sink is mounted through the bottom surface of the solid countertop, positioning at least one mounting bracket at a predetermined mounting depth below the rimless upper edge of the stainless steel sink, wherein the mounting bracket has a sink flange and a countertop flange, the countertop flange comprising a countertop flange surface which is positioned at the predetermined mounting depth below the rimless upper edge of the stainless steel sink and an adjustable countertop flange which is positionable relative to the countertop flange surface, attaching the at least one mounting bracket to the stainless steel sink, inserting the rimless upper edge of the stainless steel sink through the bottom surface of the solid countertop and into the sink mounting aperture such that the countertop flange surface is adjacent to the bottom surface of the solid countertop, adjusting the position of rimless upper edge of the stainless steel sink such that the rimless upper edge of the stainless steel sink is adjacent and substantially coplanar with the top surface of the solid countertop via the adjustable countertop flange, securing the stainless steel sink to the bottom surface of the solid countertop via the at least one mounting bracket, and applying an upper seal along an upper interface between the rimless upper edge of the stainless steel sink and the inner periphery of the sink mounting aperture through the solid countertop, wherein the upper seal prevents water, moisture, bacteria, and debris from entering between the rimless upper edge of the stainless steel sink and the solid countertop.

13. The method as recited in claim 12 wherein the mounting assembly comprises a plurality of mounting brackets each having a sink flange and a countertop flange comprising a countertop flange surface, and wherein each countertop flange surface is positioned at the predetermined mounting depth below the rimless upper edge of the stainless steel sink.

14. The method as recited in claim 12 wherein the stainless steel sink is secured to the bottom surface of the solid countertop via a countertop interconnect comprising an epoxy glue.

15. The method as recited in claim 12 wherein the upper seal comprises an epoxy resin.

16. The method as recited in claim 12 wherein the predetermined mounting depth has a tolerance of plus or minus one millimeter.

17. The method as recited in claim 12 wherein the upper interface between the rimless upper edge of the stainless steel sink and the inner periphery of the solid countertop measures less than one millimeter.

18. A method for seamless undermount installation of a stainless steel sink to a solid countertop, the method comprising:

fabricating the stainless steel sink with a rimless upper edge defining an outer periphery therearound, preparing a mounting template based on the outer periphery of the rimless upper edge of the stainless steel sink, creating a sink mounting aperture through the solid countertop between a top surface and a bottom surface based on the mounting template, wherein the sink mounting aperture comprises an inner periphery dimensioned to receive the outer periphery of the rimless upper edge of the stainless steel sink therein such that the rimless upper edge of the stainless steel sink is disposed adjacent and substantially coplanar with the top surface of the solid countertop when the stainless steel sink is mounted through the bottom surface of the solid countertop, inserting the rimless upper edge of the stainless steel sink through the bottom surface of the solid countertop and into the sink mounting aperture such that a countertop flange surface is adjacent to the bottom surface of the solid countertop and the rimless upper edge of the stainless steel sink is disposed adjacent and substantially coplanar with the top surface of the solid countertop when the stainless steel sink is mounted through the bottom surface of the solid countertop, attaching at least one mounting bracket to the stainless steel sink at a predetermined mounting depth below the rimless upper edge of the stainless steel sink, wherein the at least one mounting bracket comprises an adjustable countertop flange, securing the stainless steel sink to the bottom surface of the solid countertop via the at least one mounting bracket, and applying an upper seal along an upper interface between the rimless upper edge of the stainless steel sink and the inner periphery of the sink mounting aperture through the solid countertop, wherein the upper seal prevents water, moisture, bacteria, and debris from entering between the rimless upper edge of the stainless steel sink and the solid countertop.

* * * * *